US005133690A

United States Patent [19]

Bowe

[11] Patent Number: 5,133,690

[45] Date of Patent: Jul. 28, 1992

[54] BOOTH WITH CONTROLLED ENVIRONMENT FOR AIRCRAFT MAINTENANCE

[76] Inventor: Gerald J. Bowe, 6683 Hwy. 53, Eau Claire, Wis. 54701

[21] Appl. No.: 526,012

[22] Filed: May 21, 1990

[51] Int. Cl.[5] ..... B05B 15/12

[52] U.S. Cl. ..... 454/51; 55/467; 55/473; 55/385.2; 454/53

[58] Field of Search ..... 55/467, 473, 97, 385.2, 55/DIG. 29; 98/115.2

[56] References Cited

U.S. PATENT DOCUMENTS 2,829,582 4/1958 Abbott et al. ..... 98/115.2
4,164,901 8/1979 Everett ..... 55/385.2

FOREIGN PATENT DOCUMENTS 22938 1/1987 Japan ..... 55/385.2
669155 6/1979 U.S.S.R. ..... 98/115.2

OTHER PUBLICATIONS

Industrial Clean Rooms, by Crane, Dec. 1963, Air Conditioning, Heating & Ventilating, pp. 58–63.

*Primary Examiner*—Bernard Nozick
*Attorney, Agent, or Firm*—Oblon, Spivak, McClelland, Maier & Neustadt

[57] ABSTRACT

Disclosed is a large-scale controlled environment booth for performing maintenance operations such as painting an aircraft. The booth is a building within a building having an air circulation system, filter banks, heating and air conditioning equipment, a fume oxidizer,and circulating and exhaust air fans. The invention is capable of several modes of operation permitting thermal conditioning and complete, partial or no recirculation of air through the booth.

5 Claims, 3 Drawing Sheets

BOOTH WITH CONTROLLED ENVIRONMENT FOR AIRCRAFT MAINTENANCE

RELATED APPLICATION

This application is related to commonly owned, co-pending U.S. Pat. Application Ser. No. 07/513,790 filed Apr. 24, 1990 for Robotic Carrier Mechanism For Aircraft Maintenance.

BACKGROUND OF THE INVENTION

Field of the Invention

In the above noted commonly owned patent application, a robotic carrier mechanism for aircraft maintenance is disclosed, the mechanism being capable of numerous activities in the course of aircraft maintenance such as painting, cleaning, surface etching, and the like.

SUMMARY OF THE INVENTION

It is an object of the present invention to provide a structure to house the mechanism disclosed in Ser. No. 07/513,790. This structure has an enclosed portion with means to control the environment within, if desired.

It is also an object of the present invention to provide a structure having an area wherein the environment may be controlled for certain maintenance operations and not controlled or only partially controlled for other maintenance operations.

The robotic carrier mechanism of the type disclosed in co-pending U.S. Ser. No. 07/513,790 is very large. It is used to perform maintenance operations on aircraft, which are also very large. Operations such as painting cannot be successfully performed in other than a controlled environment, while other operations require less control.

The present invention provides a structure or building which contains an enclosed volume of space, designated the booth, in which the environment may be controlled as desired. The booth can be operated in two or more separate modes. A first mode enables all of the air within the booth to be exhausted and replaced with ambient (but filtered) air from outside the enclosure. A second mode thermally conditions air within the booth, either by cooling or heating, and exhausts only a minor percentage of the air within the booth to a fume oxidizer for control of VOC's (volatile organic compounds). The air so exhausted is replaced with an equivalent amount of filtered and thermally conditioned air.

The booth is basically a building within a building i.e., a large confined volume of space large enough to contain an aircraft and the aforementioned robotic carrier mechanism contained within a larger building such as an aircraft hanger or the like. The dimensions of the booth may be 90 feet wide, 105 feet deep and 30 feet high. One end has a door that may be 22 feet high and 65 feet wide that allows an airplane to be moved into the booth. Approximately 10 feet inwardly from the door is a large set of filters slidable on tracks similar to patio doors. When slid back, the airplanes can pass through and when closed, all air entering the booth passes through the filters.

To the rear of the booth is a bank of air processing equipment including circulating fans, filters, thermal conditioning means to heat or cool air, a fume oxidizer, and ducts to recirculate and exhaust air.

To one side of the booth are isolated smaller areas containing robotic controls, paint storage and mixing, and miscellaneous equipment.

The ceiling of the booth encloses an air plenum, which is defined by the roof of the structure, the ceiling of the booth, and the side walls of the structure. This plenum permits the circulation of air from the rear of the booth to the front bank of filters.

To thermally condition all the air in the booth and continually replace the same would be prohibitively expensive. The present invention contemplates at least two modes of operation. In operations not requiring thermally conditioned air, ambient air can be drawn through the front filters, circulated through the booth, and exhausted at the rear. Since no air is re-circulated through the booth, this mode involves 100% make-up—i.e., complete and continuous replacement of all of the air in the booth. A second mode is employed when thermal conditioning is required. In such a mode, and by way of example, a total airflow of 36,000 cubic feet per minute (CFM) occurs within the booth, 26,000 CFM of which is recirculated and 10,000 CFM of which is exhausted and replaced with fresh, filtered air from outside the structure. The exhausted 10,000 CFM of air may be passed through a fume oxidizer to oxide the VOC's into carbon dioxide and water vapor. The replacement 10,000 CFM of air is thermally conditioned and filtered before it is circulated in the region of the airplane.

A third mode contemplates heating re-circulating air to the 130° F.-140° F. range to facilitate drying of liquids on the airplane such as paint.

Further features of the invention will be apparent from a consideration of the detailed description of a preferred embodiment of this invention, and a consideration of the accompanying drawings.

DESCRIPTION OF A PREFERRED EMBODIMENT

Figure 2:
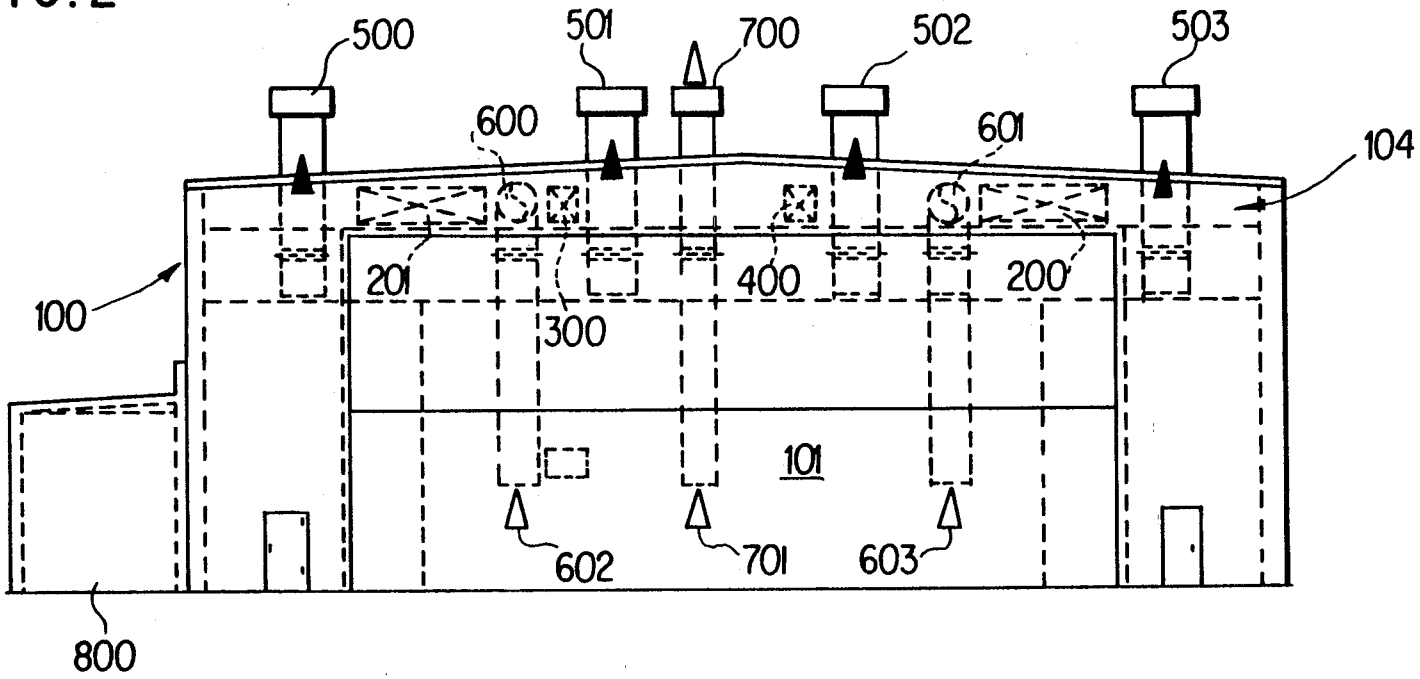
FIG. 2 is an end view of the access-door end of the building of FIG. 1, with certain exhaust and recirculation ducts shown at the rear end of the building.

As seen in FIG. 2, there is provided a building or structure 100 consisting of four walls and a roof. Enclosed within building 100 is a booth 101 having, for example, a working depth of approximately 105 feet, a clear working height of approximately 30 feet and a working width of approximately 90 feet. Building 100 is slightly larger than booth 101, having, for example, a depth of approximately 126 feet, a width of approximately 93 feet, and a height of approximately 35½ feet.

Figure 1:
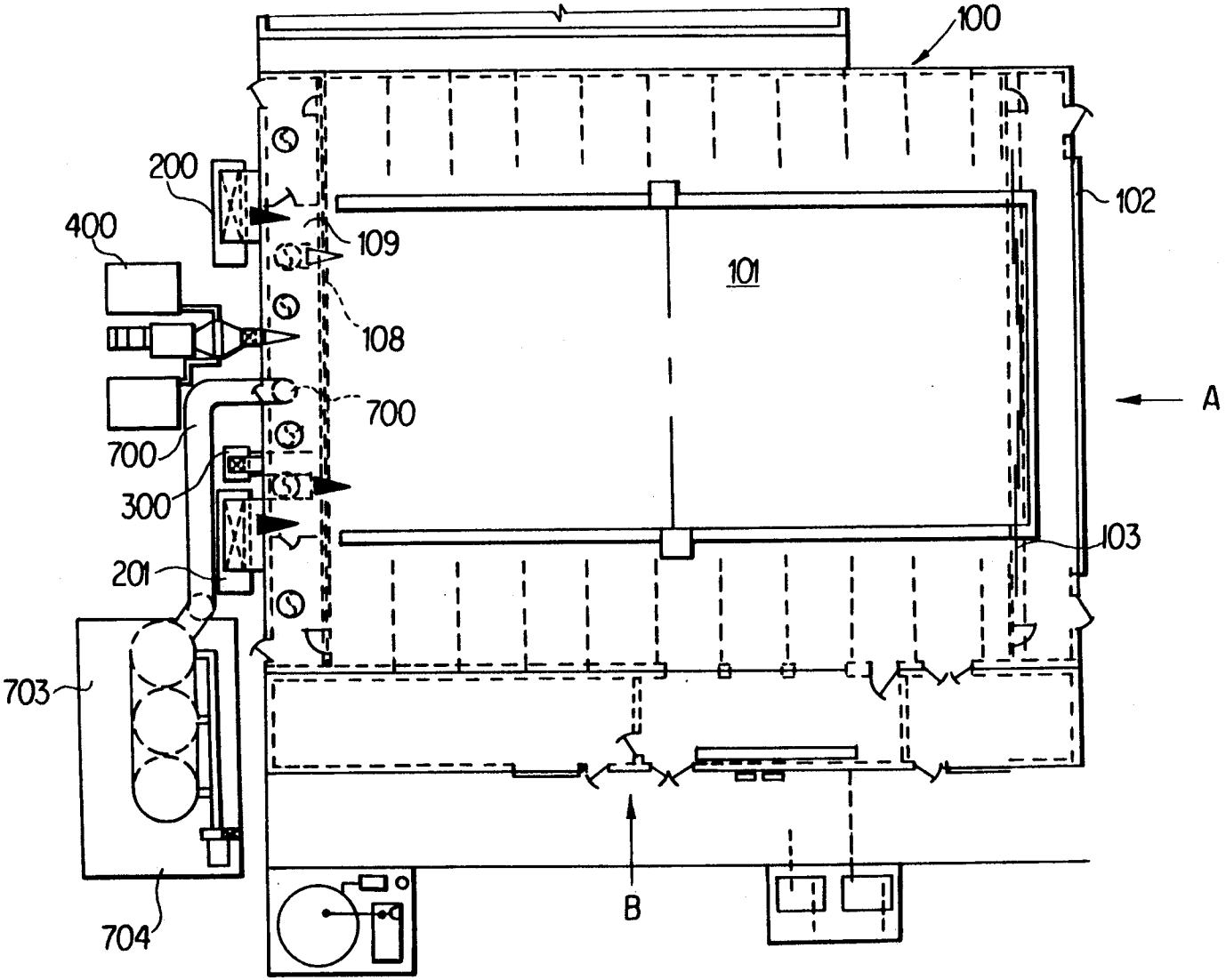
FIG. 1 is a top view of the building containing the booth, with the roof of the building and ceiling of the booth removed for clarity.

The entry end of building 100 is shown in FIG. 1. It has an electrically operated bi-fold door 102 approximately 30 feet high and 65 feet wide and provides, when open, an access height of approximately 24 feet.

Located approximately 8 feet interiorly of the entry door 102 is a first filter bank 103 which comprises a plurality of 20′×20′ sliding filter panels movable in tracks somewhat like a series of patio doors. When all the panels are closed, they constitute the front wall of booth 101.

The roof of building 100 is supported by a number of conventional trusses, the bottoms of which define a plane approximately 30½ feet up from the floor. This plane is partially closed with sheet metal or the like and constitutes the bottom surface of a circulatory air plenum 104. Approximately the front 10 feet and the rear 10 feet of the building ceiling is open to below so that air circulates from the front of the building to the back in the region of the airplane, and from the back of the building to the front in air plenum 104 in the ceiling.

Figure 3:
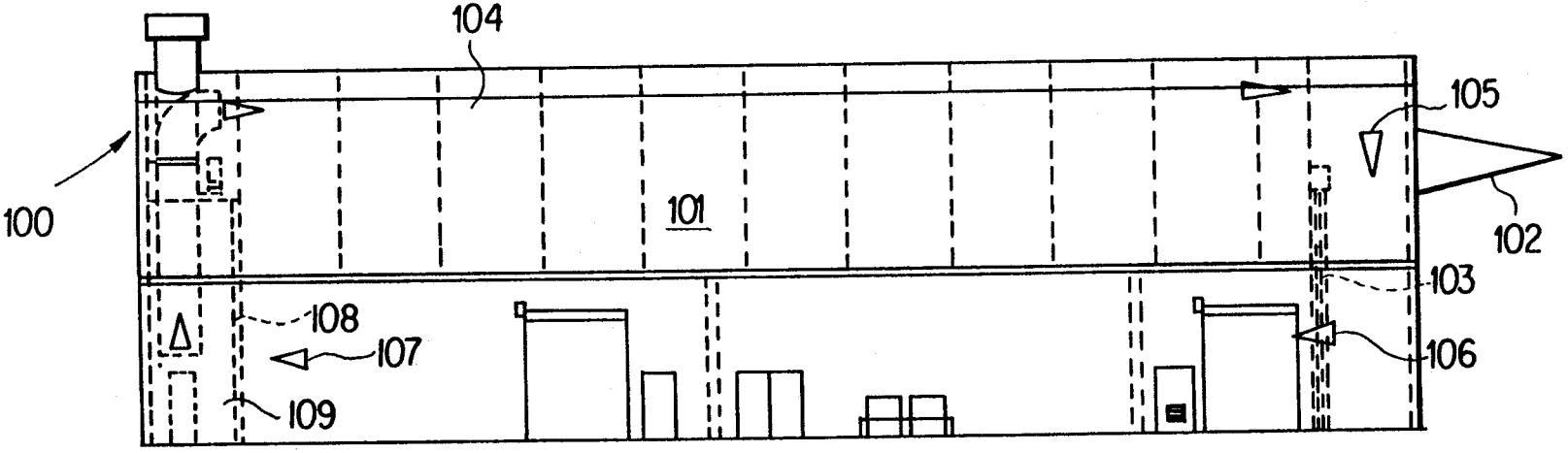
FIG. 3 is a side view of the building shown in FIG. 1.

Arrowhead 105 (FIG. 3) illustrates the path of the airflow downward from plenum 104 to a region between door 102 and filter bank 103. With such a path, all air passes through filter bank 103 before it is circulated into booth 101. Filters 103 are tacky intake filters capable of filtering particles down to 5 microns in size.

The air path, after passing through filter bank 103, continues to the rear of the building, as shown by arrowheads 106, 107, and passes through a second filter bank 108 in the rear of the booth. This filter material may be conventional fiberglass filter matting of the type used in home furnaces.

After passing through filter bank 108, the air passes into a rear air treatment chamber 109. This chamber is the same height and width as the building, and is approximately ten feet deep. The conditioning, mixing, and exchanging of air occurs within this chamber 109.

The following devices process air in the region of chamber 109.

Elements 200 and 201 are propane fired air make-up units capable of heating air to the 130° F.–140° F. range for the drying of either wash water or paint on the plane. They are both located outside the building 100, but communicate with chamber 109 with ducts passing through the walls into chamber 109 and plenum 104. Both units 200 and 201 have fans capable of 65,000 CFM of air.

Element 300 is a booth freeze protection recirculating air make-up unit with a capacity of 10,000 CFM and a propanefired heater capable of heating booth 101 to only a safety level to avoid freezing of pipes and the like. This unit would typically be used during cold weather when the booth is not occupied and not in use.

Element 400 is an air make-up unit with propane-fired heating means, and cooling means including an evaporator coil and condensing unit for air cooling and humidity control. It may also include an electric reheating coil for back-up heating of the air.

Both elements 300 and 400 communicate with chamber 109 and plenum 104 through ducts in the rear wall of building 100.

As best seen in FIG. 2, exhaust ducts 500, 501, 502 and 503 communicate with the upper portion of chamber 109, and exhaust booth air to the exterior of building 100. Each duct contains a 48" axial fan capable of approximately 32,500 CFM. The tops of these exhaust ducts extend approximately six feet above the roof line of building 100.

Elements 600 and 601 are recirculating ducts that have intakes at arrowheads 602 and 603 (FIG. 2) i.e. approximately eight feet above floor level. Each element contains a recirculating 29" axial flow exhaust fan of 13,000 CFM capacity. The upper portion of ducts 600 and 601 communicate with plenum 104, and blow air toward the front end of building 100.

Element 700 is an exhaust duct with an intake approximately eight feet from the floor (arrowhead 701), and having therein a 29" axial flow exhaust fan of 10,000 CFM capacity with an explosion proof electric motor. Best visible in FIG. 1 (and not shown in FIG. 2), the outlet of element 700 communicates through duct 702 with fume oxidizer 703, located outside the building on a separate pad 704. This oxidizer is gas fired and lined with refractory ceramic such that substantially all VOC's passing therethrough can be converted to carbon dioxide and water vapor.

A small ancillary addition 800 to building 100 is attached to one side of building 100. It contains several additional areas for robotic controls, paint mixing & storage, and miscellaneous equipment. Separate heating and cooling means are provided for these areas.

The booth may be operated in several modes. If ducts 500, 501, 502 and 503 are in full operation, 100% air make-up, or replacement occurs. In this mode, the air circulating through the booth would be filtered but otherwise unconditioned. A second mode would involve the use of air make-up units 200 and 201 to greatly heat the circulating air communicated to dry liquids on the surface of the plane. Another mode could involve heating and/or cooling of the circulating air with air make-up unit 400, with a partial exhaust of VOC-laden air through fume oxidizer 704. As stated above, the venting and replacement of 10,000 CFM in combination with recirculation of 26,000 CFM of air through the booth provides economies in terms of utility costs, yet enables control of the booth to 78° F. ± 8° and 50% ± 10% relative humidity.

The exterior walls and roof building 100 may be of steel and can be insulated to a suitable U-factor of 0.1 and 0.05 respectively. Appropriate lighting and plumbing are provided in the building, as well as a floor drainage system leading to an exterior tank or sump.

What is claimed as new and desired to be secured by letters patent of the U.S. is:

1. An aircraft maintenance booth comprising:

a building having a volume of space therewithin and a door for permitting entry of an aircraft, air circulation means connected to said building for circulating air at atmospheric pressure into and out of said volume of space such that air replacement in said volume of space occurs, at least one thermal conditioning element connected to and in communication with said means for circulating thermally conditioned air into said volume of space, fume oxidizer means connected to and in communication with said means for circulating air into and out of said volume of space, filter means positioned along opposite walls of said volume of space for filtering out particulates in the air of at least 5 microns in size, and means for operating said means for circulating air, means for operating said thermal conditioning means, and means for operating said fume oxidizer means for producing thermal conditioning of air through said volume of space.

2. An aircraft maintenance booth as set forth in claim 1, wherein said thermal conditioning means comprises means for conditioning the air within said building so as to have a temperature of 78° F. ± 8°.

3. An aircraft maintenance booth as set forth in claim 2, wherein said means for conditioning the air comprises means for adjusting the relative humidity of the air so as to be 50% ± 10%.

4. An aircraft maintenance booth as set forth in claim 1, wherein the thermal conditioning means comprises means for heating the air circulated into the volume of space so as to have a temperature in the range of 130°-140° F.

5. The air craft maintenance booth as set forth in claim 1, which comprises an air treatment chamber positioned in said building and with which said filter means is connected.

* * * * *